United States Patent [19]

Howorth

[11] 4,067,162

[45] Jan. 10, 1978

[54] BUILDING CONSTRUCTION

[75] Inventor: Ronald Howorth, Littleborough, England

[73] Assignee: BTR Industries Limited, London, England

[21] Appl. No.: 745,826

[22] Filed: Nov. 29, 1976

[30] Foreign Application Priority Data

June 23, 1976 United Kingdom ..... 26172/76

[51] Int. Cl.[2] ..... E04B 1/38

[52] U.S. Cl. ..... 52/393; 52/235; 52/578; 52/660

[58] Field of Search ..... 52/393, 235, 578, 660, 52/663, 664, 396

[56] References Cited

U.S. PATENT DOCUMENTS

| | | | |
|---|---|---|---|
| 3,052,330 | 9/1962 | Hammitt et al. | 52/235 |
| 3,805,465 | 4/1974 | Dietrich | 52/235 |
| 3,838,546 | 10/1974 | Tempes | 52/235 |

FOREIGN PATENT DOCUMENTS

| | | | |
|---|---|---|---|
| 1,555,046 | 12/1968 | France | 52/235 |

*Primary Examiner*—J. Karl Bell

*Attorney, Agent, or Firm*—Watson, Cole, Grindle & Watson

[57] ABSTRACT

A lattice portion of elastomeric material comprises a generally rectangular framework for sealing at least one cladding panel in a building construction. The lattice portions have at least one member protruding from each corner of the rectangle and being an extension of a side of the rectangle. The lattice portions are preformed, assembled on a structure of a building and joined together to form a continuous lattice by forming junctions between adjacent lattice portions or between lattice portions and intermediate spacing which may connect the lattice portions. The completed lattice is attached to the building and cladding panels inserted into the lattice.

18 Claims, 3 Drawing Figures

BUILDING CONSTRUCTION

BACKGROUND TO THE INVENTION

The invention relates to building construction and more but not exclusively to building cladding, that is to the provision of an outer facing particularly, for buildings of the type comprising a structure or at least a structural framework and a plurality of cladding panels which are retained in position on the structure or framework.

In known buildings of this type, the cladding panels are retained on the shell of the building by a plurality of jointing members which are placed around the peripheries of the cladding panels to form a lattice. The jointing members comprise extruded sections which usually fit around the edges of the cladding panels and are joined together at the corners of the panels, where horizontal and vertical jointing sections meet, to form the lattice. Prior art methods of forming these joints between the sections have included caulking and glueing but, by these methods, it is difficult to make a water tight seal, particularly at 4-way joints where four sections meet. Furthermore, a large number of such joints are necessary to create a lattice for an entire building and so the problem of water-tightness is multiplied.

SUMMARY OF THE INVENTION

The present invention seeks to overcome or reduce this problem and provides a method of constructing a lattice for sealing cladding panels on a structure or structural framework of a building, said method comprising the steps of preforming a plurality of lattice portions of elastomeric material, each lattice portion comprising at least an X-shaped member capable, in use, of locating a corner of each of four adjacent cladding panels, assembling said preformed lattice portions on a structure or structural framework of a building and joining together said preformed lattice portions into a continuous lattice by vulcanizing (or solvent welding, or hot knife jointing, if thermoplastic rubbers are being used) junctions between adjacent lattice portions or between lattice portions and intermediate spacing members which may connect the lattice portions.

Preferably each lattice portion comprises a generally rectangular framework for sealing at least one cladding panel and at least one member protruding from each corner of the rectangle and being an extension of a side of the rectangle. There may be two mutually perpendicular members protruding from each corner, said members being extensions of two adjacent sides of the rectangle.

Preferably the or each protruding member extends from the framework for a distance of half the length of the side of the rectangle from which the member extends.

The invention also provides a method of cladding a building, said method comprising the steps of constructing a lattice as described above, attaching the lattice to the building and inserting cladding panels into the lattice.

The invention further provides a lattice portion as described above, per se, and still further provides a building including a lattice as described above.

A preferred embodiment of a lattice and method of construction of same according to the invention will now be described with reference to the accompanying drawings.

Figure 2A:
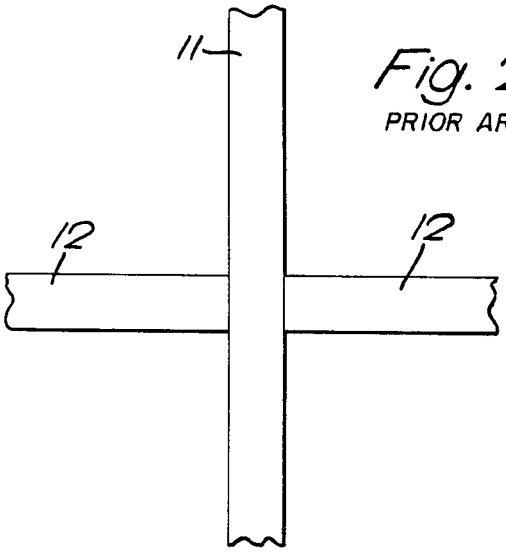
Fig. 2A. PRIOR ART
FIGS. 2A and 2B show two prior art joints between adjacent lattice members.
Figure 2B:
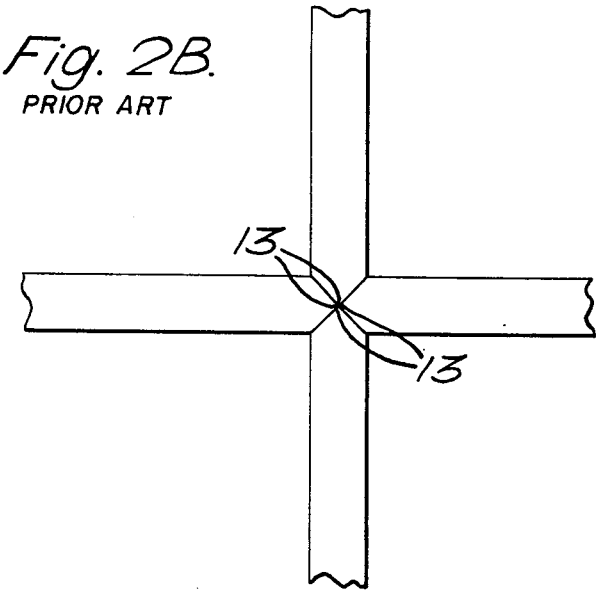
Fig. 2B. PRIOR ART

It is a well known practice in the construction of buildings to first build a structural frame comprising the walls and roof of the building and then to clad the walls with cladding panels which are usually sealed by independent vertical and horizontal jointing sections. When such cladding panels are placed on the structural frame of a building there is a need to render them weather tight. This has been attempted in the past by either caulking the vertical and horizontal joints between the panels with mastic or by using resilient elastomeric extrusions to form a lattice. When such a lattice is formed, there is a problem in sealing the intersections of the vertical and horizontal joints. Prior art ways of doing this are shown in FIG. 2. Either the vertical lattice member 11 is made continuous and the horizontal members 12 butt against it as shown in the FIG. 2A or all four ends of the joining members are mitred 13 as in FIG. 2B. In either case some kind of wet applied sealant or adhesive must be applied at each joint and this is an expensive operation in time and labor.

Figure 1:
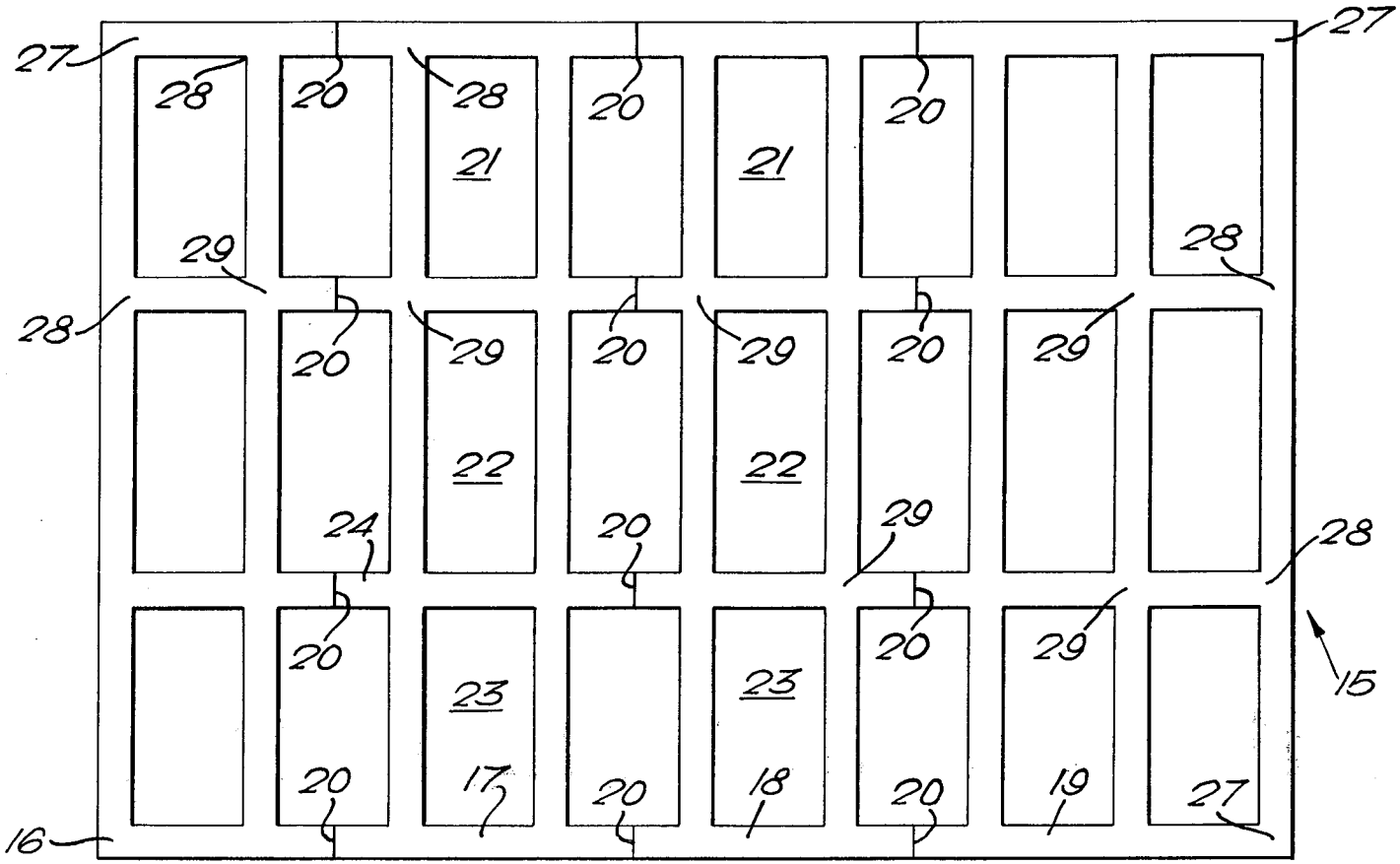
FIG. 1 shows a lattice for a building.

A lattice produced according to the invention is shown in FIG. 1. The lattice 15 comprises a number of preformed lattice portions 16, 17, 18, 19 which are joined together on site at the joints 20. In the particular embodiment shown the lattice portions 17, 18 are each designed to accommodate three cladding panels at 21, 22, 23 and include protruding members 24 for connection to adjacent lattices, each protruding member being half the length of a side of one of the cladding panels.

The lattice portions are preformed in a factory as follows:

A resilient elastomeric jointing member of suitable cross-section is extruded and vulcanised (or just extruded in the case of thermoplastic rubbers) and is then used to form the lattice portions which are vulcanized (or jointing by suitable techniques if thermoplastic rubbers are used) into an integral structure in the factory. Thus all the two-way, three-way and four-way joints 27, 28, 29 respectively are moulded in the factory. In this way, a lattice portion is constructed of the maximum size commensurate with reasonable ease of handling.

The lattice portions are then transported to the site of the building to be clad and there they are assembled into the complete lattice shown and the joints 20 are vulcanised (or jointing by suitable techniques if thermoplastic rubbers are used) using a suitable press. The cladding panels may then be inserted into the lattice.

It will, of course, be realized that the exact configuration of the lattice portions and the number of cladding panels accommodated by each one will depend on the size of the panels and the building to be clad.

The jointing extrusions themselves may differ in cross section, and will be designed bearing in mind the material from which the panels are made, the type of profile which may be introduced into the panel edge detail, and the need to use the joint area as a drainage channel. The sections may well be designed as gutters connecting all the panels laterally and longitudinally, they may be used over roof areas, as well as along the elevations of walls, and may in themselves be the accepted method of draining off the surface water from the building.

The advantage of this lattice jointing system is that, at the critical four-way junctions, the integrity of the joint is preserved by the four way mould, which gives complete weathertightness. Subsequently the site made joints which are also vulcanised (or jointing by suitable techniques if thermoplastic rubbers are used) give a completeness to the jointing system for the whole building, which is better than using adhesives and sealants, etc., at the intersection of the vertical and horizontal jointing sections. Without a vulcanized (or moulded) joint the intersection of the different joint lengths must be suspect even when newly and carefully made, and more so with the passage of time.

The system also allows for the thermal movements of the panels and or structural frame.

I claim:

1. A method of constructing a lattice for sealing cladding panels on a structure of a building comprising the steps of preforming a plurality of lattice portions of elastomeric material, each lattice portion comprising a generally rectangular framework for sealing at least one cladding panel and at least one member which is an extension of a side of the rectangle extending from each corner of the rectangle a distance of half the length of the side of the rectangle from which the member extends, assembling said preformed lattice portions on a structure of a building and joining together said preformed lattice portions into a continuous lattice by forming junctions between adjacent lattice portions or between lattice portions and intermediate spacing members which connect the lattice portions.

2. A method as claimed in claim 1 wherein each lattice portion includes two mutually perpendicular members protruding from each corner, said members being extensions of two adjacent sides of the rectangle.

3. A method of cladding a building, said method comprising the steps of constructing a lattice as claimed in claim 1, attaching the lattice of the building and inserting cladding panels into the lattice.

4. A method of cladding a building as claimed in claim 3 wherein each lattice portion includes two mutually perpendicular members protruding from each corner, said members being extensions of two adjacent sides of the rectangle.

5. A method of cladding a building as claimed in claim 4 wherein said protruding members protruding from each corner extend from the framework for a distance of half the length of the side of the rectangle from which the member extends.

6. A lattice portion of elastomeric material comprising a generally rectangular framework for sealing at least one cladding panel and at least one member protruding from each corner of the rectangle and being an extension of a side of the rectangle, said member extending from the framework for a distance of half the length of the side of the rectangle from which the member extends.

7. A lattice portion as claimed in claim 6 having two mutually perpendicular members protruding from each corner, said members being extensions of two adjacent side of the rectangle.

8. A building including a lattice as claimed in claim 6.

9. A method for constructing a lattice for sealing cladding panels on a structure of a building comprising the steps of preforming a plurality of lattice portions of elastomeric material, each lattice portion comprising a generally rectangular framework for sealing at least one cladding panel and at least two mutually perpendicular members protruding from each corner of the rectangle and being extensions of two adjacent sides of the rectangle, assembling said preformed lattice portions on a structure of a building and joining together said preformed lattice portions into a continuous lattice by forming junctions between adjacent lattice portions or between lattice portions and intermediate spacing members which connect the lattice portions.

10. A method as claimed in claim 9 wherein both said members protruding from each corner extend from the framework for a distance of half the length of the side of the rectangle from which the member extends.

11. A method of cladding a building, said method comprising the steps of constructing a lattice as claimed in claim 9, attaching the lattice to the building and inserting cladding panels into the lattice.

12. A method of cladding a building as claimed in claim 11 wherein each protruding member extends from the framework for a distance of half the length of the side of the rectangle from which the member extends.

13. A lattice portion of elastomeric material comprising a generally rectangular framework for sealing at least one cladding panel and two mutually perpendicular members protruding from each corner of the rectangle and being extensions of two adjacent sides of the rectangle.

14. A lattice portion as claimed in claim 13 wherein both said members protruding from each corner extend from the framework for a distance of half the length of the side of the rectangle from which the member extends.

15. A method of constructing a lattice for sealing cladding panels on a structure of a building comprising the steps of preforming a plurality of lattice portions of elastomeric material, each lattice portion comprising a four sided framework for sealing at least one cladding panel and at least one member which is an extension of a side of the framework extending from each corner of the framework a distance of half the length of the side of the framework from which the member extends, assembling said preformed lattice portions on a structure of a building and joining together said preformed lattice portions into a continuous lattice by forming junctions between adjacent lattice portions or between lattice portions and intermediate spacing members which connect the lattice portions.

16. A method of constructing a lattice for sealing cladding panels on a structure of a building comprising the steps of preforming a plurality of lattice portions of elastomeric material, each lattice portion comprising a four-sided framework for sealing at least one cladding panel and at least one member protruding from each corner of the framework and being an extension of a side of the framework, assembling said preformed lattice portions on a structure of a building and joining together said preformed lattice portions into a continuous lattice by forming junctions between adjacent lattice portions or between lattice portions and intermediate spacing members which connect the lattice portions.

17. A method of constructing a lattice for sealing cladding panels on a structure of a building comprising the steps of preforming a plurality of lattice portions of elastomeric material, each lattice portion consisting of one X-shaped member capable, in use, of locating a corner of each of four adjacent cladding panels, assembling said preformed lattice portions on a structure of a building and joining together said preformed lattice portions into a continuous lattice by forming integral junctions between adjacent lattice portions or between lattice portions and intermediate spacing members which connect the lattice portions.

18. A method of constructing a lattice for sealing cladding panels on a structure of a building where the lattice comprises two sets of parallel, elongate, elastomeric members, the members of one set intersecting the members of the other set, the method comprising the steps of preforming a plurality of lattice portions of elastomeric material, each lattice portion comprising at least two intersecting elongate members forming a X-shape, assembling said preformed lattice portions on the structure of a building to form the aforesaid lattice and joining said preformed lattice portions together by integrally joining together the free ends of the aforesaid intersecting elongate members with the free ends of the intersecting elongate members of other lattice portions with or without the interposition of an elongate spacing member.

* * * * *